United States Patent [19]

Erämetsä et al.

[11] Patent Number: 4,842,336

[45] Date of Patent: Jun. 27, 1989

[54] METHOD AND DEVICE FOR COLLECTING OBJECTS FROM THE SEABED

[75] Inventors: Henrik Erämetsä, Turku; Kari Kuvaja, Tampere; Kalevi Mäki-Kihniä, Vesilahti; Jorma Terävä, Tampere, all of Finland

[73] Assignee: Rauma-Repola Oy, Tampere, Finland

[21] Appl. No.: 130,328

[22] Filed: Dec. 8, 1987

[30] Foreign Application Priority Data

Dec. 8, 1986 [FI] Finland ..... 864998

[51] Int. Cl.[4] ..... E02F 3/88; E21C 45/00

[52] U.S. Cl. ..... 299/8; 37/62; 37/DIG. 8

[58] Field of Search ..... 299/819; 37/58, 61, 37/62, 64, 68, DIG. 8

[56] References Cited

U.S. PATENT DOCUMENTS

| | | | |
|---|---|---|---|
| 532,183 | 1/1895 | Pike | 299/8 |
| 3,624,932 | 12/1971 | Doyle | 37/55 |
| 4,018,483 | 4/1977 | Smith | 37/58 X |
| 4,042,279 | 8/1977 | Asakawa | 299/8 |
| 4,053,181 | 10/1977 | Saito | 299/9 |
| 4,141,159 | 2/1979 | Morris et al. | 37/DIG. 8 X |
| 4,368,923 | 1/1983 | Handa et al. | 299/8 |
| 4,503,629 | 3/1985 | Uchida | 37/DIG. 8 X |

FOREIGN PATENT DOCUMENTS

| | | |
|---|---|---|
| 403392 | 12/1975 | Sweden . |
| 1598776 | 9/1981 | United Kingdom . |
| 2097839A | 11/1982 | United Kingdom . |

*Primary Examiner*—Stephen J. Novosad
*Assistant Examiner*—David J. Bagnell
*Attorney, Agent, or Firm*—Burns, Doane, Swecker & Mathis

[57] ABSTRACT

Method and device for collecting objects pointing out of the bottom level of seas or corresponding water areas so that the objects are carried from the bottom by using waterflow through an intake opening of the collecting device moving on the bottom of the sea. The objects are removed from the bottom by a removing device. The lowermost part of the removing device moves at the same level with the bottom of the water area or above it. The most suitable way of removing the objects from the bottom is by using water spray, the flow power of which is controlled separately from the flow power of the water in the conveying channel.

20 Claims, 4 Drawing Sheets

METHOD AND DEVICE FOR COLLECTING OBJECTS FROM THE SEABED

BACKGROUND OF THE INVENTION

1. Field of the Invention

This invention comprises a method and device for collecting objects pointing out of the bottom level of seas or corresponding water areas so that the objects are conveyed from the seabed by using a collecting device which moves on the bottom of the sea.

2. Description of Related Art

Pieces of mineral, so-called mangan nodules, can be found in the mud at a depth of about 4.5 to 6 km. at the bottom of oceans. The nodules are oval tubers, the minimum diameter of which is approx. 10 to 50 mm. Besides mangan these nodules contain valuable minerals, such as cobolt, nickel and copper. The nodules are to be found on the surface of the mud layers.

Different kinds of equipment have been developed to collect and restore these nodules. The equipment includes a collecting head which moves on the seabed picking up nodules. The nodules are conveyed to a vessel on the surface of the sea by means of hoses by pumping or by using compressed air or by using a hoistable basket. For example U.S. Pat. No. 4,042,279 describes a collecting head solution which uses water flow for collecting nodules.

The problem with the collecting head using water flow is that the intake power needed to remove the nodules is much greater than the power needed to convey the nodules. Large amounts of mud come up with the nodules. Mud has to be separated from the nodules in some way, but the muddy discharge water flow hampers the operation of the equipment located in the collecting head, for example, the echosounder. In addition, mud goes down to the bottom again slowly, which means that the water will be clear only after several days.

SUMMARY OF THE INVENTION

A characteristic of the method of the present invention is that the lowermost part of the removing device moves on the same level with the bottom of the sea area or above it.

A characteristic of the device of the present invention is that the lowermost part of the removing device has been fitted so that it is placed on the same level with the bottom of the sea area or above it. The most suitable removing device is a spray of water. The flowing power of which can be adjusted separately from the flowing power of the conveying channel.

The bottom level means the level under which the shearing strength of the mud layer is at least 0.3 kPa. Above the bottom level there is an approx. 2 cm thick layer of sediment, which, however, does not have any carrying capacity.

When separate removing devices are used along with waterflow to remove nodules, a relatively small intake power can be used for conveying the nodules, and the amount of mud coming up with the nodules is smaller compared with that coming up with the water flow in the earlier used device which was operated by waterflow. If the removing device is mechanical, also it has to be fitted so that it touches only the top of the nodules and will not scratch mud with it.

When the flowing power of the removing spray is adjusted separate from the power of the conveying flow, the minimum and maximum size of the collected nodules can be selected by adjusting the water sprays. In this way quite small and also oversized nodules remain on the bottom. Depending on the quality of the sea bottom, mainly its shearing strength and construction, a certain relation between the power of the removing spray and the power of the conveying flow can be selected, whereby an optimal total effect can be reached.

When the conveying flow is kept relatively small, the amount of mud coming along is also small and heavy nodules will not be conveyed with the flow but drop away. In addition, scrap etc. which possibly lie on the bottom are not taken along with the flow. Earlier devices have had to be equipped with a separate screen for separating too big nodules from the flow. Moreover, the mud coming with the flow penetrated into the holes and cavities of the devices, which impaired the operation of the devices and made cleaning very difficult.

When the power of the removing spray is correct in relation to the power of the conveying flow, the removing spray can be made to move upwards in the vicinity of the bottom level, whereby the smallest nodules will not be removed from the bottom.

BRIEF DESCRIPTION OF THE DRAWINGS

The invention and its details are described closer in the following with reference to the adjoining drawings, of which

DESCRIPTION OF THE PREFERRED EMBODIMENTS

Figure 1:
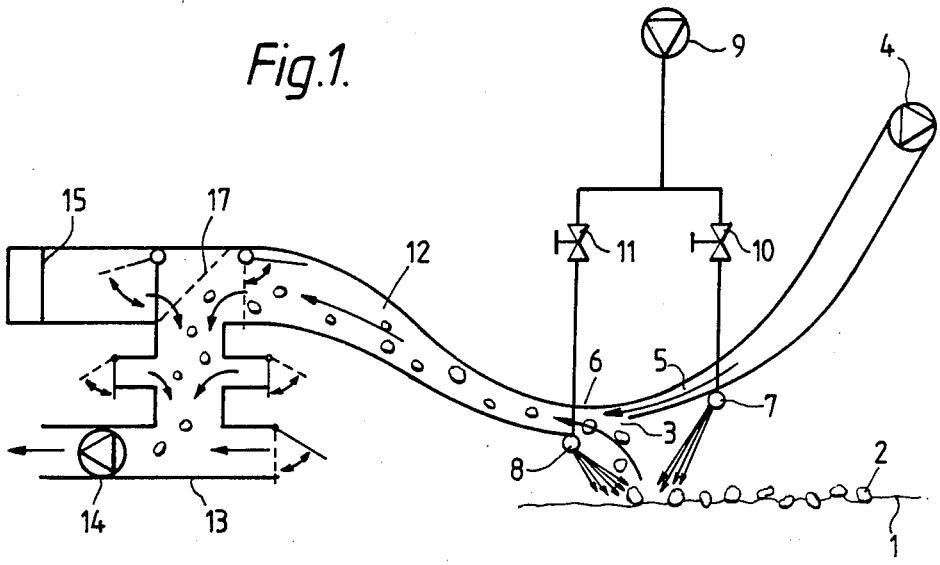
- FIG. 1 is a diagram of the collecting device as described in the invention as a vertical shear.
Figure 2:
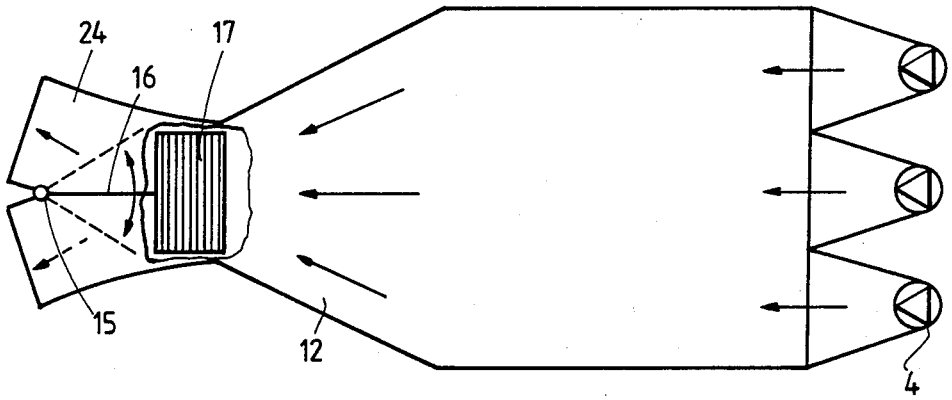
- FIG. 2 is an illustration of the same device of FIG. 1 as seen from above.

FIGS. 1 and 2 show the intake and conveying part of the collecting device. To make the figures clearer, they are shown without the frame of the collecting device. The frame moves on the seabed for example by means of tracks and its own operating mechanism or by means of skids drawn by a vessel above the surface of the water. Some other suspending or travelling mechanism may be used, too. The suspending equipment located on the sides of the device, for example tracks or skids, is on the same level with the bottom, and as for all the other parts the lower surface of the device does not come into contact with the bottom, i.e., above the bottom level. In FIGS. 1 and 2 the travelling direction is from the left to the right. The travelling speed is about 1 m/s.

On the seabed 1, there are nodules 2 which are collected by the collecting device through intake opening 3. In the application, in FIGS. 1 and 2, the suction and flow conveying the nodules in is brought about by means of the nozzle 5 above the pump 4 and the intake opening. In FIG. 2 three pumps and nozzles are shown parallel to each other. Nozzle 5 leads the waterflow tangentially above the upper surface 6 of the intake device. The lower side of upper surface 6 is convex. Curved upper surface 6 makes the flow turn further upwards. The flow brings about suction at intake opening 3, which takes nodules up with it. The nodules have been removed from the mud at the sea bottom by means of transverse spray pipes 7 and 8 located behind and in front of the intake opening. The spray pipes are located somewhat above the bottom level and there are spray openings at about 20 mm distance from each other at the lower part of the pipes. The spraying angle of the spray pipes can be adjusted, for example by turning the pipes round their longitudinal shaft. Flow in the spray pipes is caused by pump 9. The power of the removing sprays can be adjusted by the help of valves 10 and 11, and, when necessary, either or both of the spray pipes can be made inoperative. Pump 4, which is used for bringing about waterflow for the conveying motion, may be a propeller pump, as the pressure required for the conveying need not be higher than 0,5 to 2 bar, whereas the capacity flow must be greater. However, the pressure of the removing spray should be higher, for example 2 to 6 bar, so the recommended type of pump used as pump 9 is a centrifugal pump.

The nodules are led through the intake opening 3 to the conveying channel 12 which becomes narrower in width after the intake opening. In this way the nodule flow can be directed above the collecting basket 13 which is narrower in width than the intake opening 3. In order not to make the diameter of the flow channel too small, the height of the channel is increased where the width of it is smaller.

At the top of collecting basket 13 there is a separation screen 17 at which the nodules fall down on the bottom of the basket by gravity. From there the nodules are conveyed further forward by means of a pump 14. The mud flow, however, is led further at the top of the basket through the screen 17. To make the mud flow in the desired direction, a flow pipe 24, which is meant for removing mud, has two branches. One of the branches leads to the left and the other to the right. Between the branches there is a control flap 16 which turns around a hinge 15. The collecting basket can be fitted with even more control flaps used for controlling water flow to the basket. Instead of turning flap 16 and the two-branch pipe also turning discharge pipe can be used, or the direction of the discharge opening can be adjusted in some other way.

Figure 3:
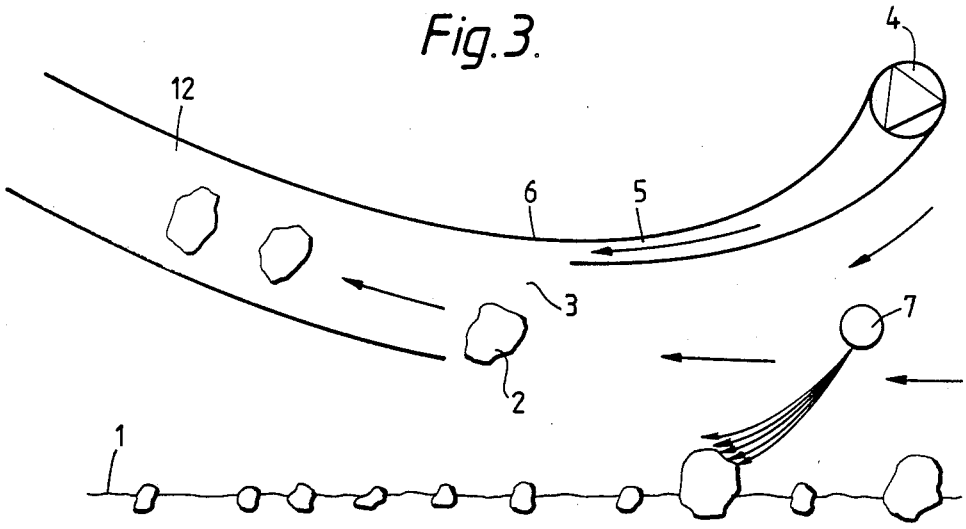
- FIGS. 3 and 4 are views of the intake opening of the collecting device as a vertical shear and the effect of the removing spray.

FIG. 3 shows how removing spray 7 is curved in front of intake opening 3, so that the spray will not remove nodules that are smaller than the desired minimum size. Curving is brought about by determining the relation between the power of removing spray 7 and the power of the flow of the conveying channel 12 such that the conveying flow will turn the removing spray at the desired height.

Figure 4:
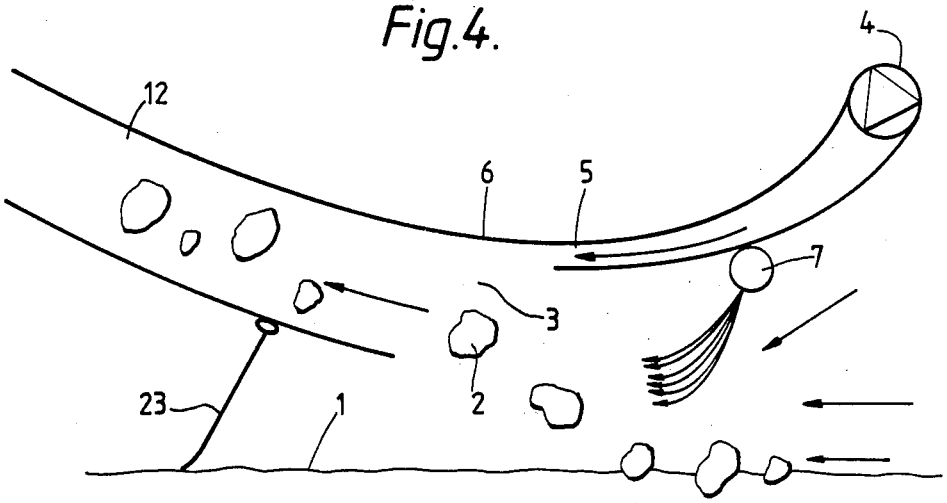

With reference to FIG. 4, a flexible rubber splint 23 is located behind the intake opening 3. Removing spray 7 leads the main flow coming to the intake opening into a narrower opening. This is to increase the flow speed, i.e., collecting effect, near the bottom.

Figure 6:
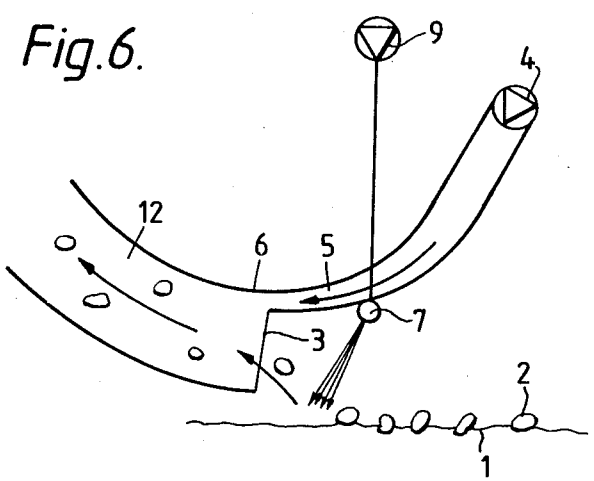
- FIGS. 5 to 8 are views of different applications of the intake opening of the collecting device and the location of the removing device as a vertical shear.
Figure 5:
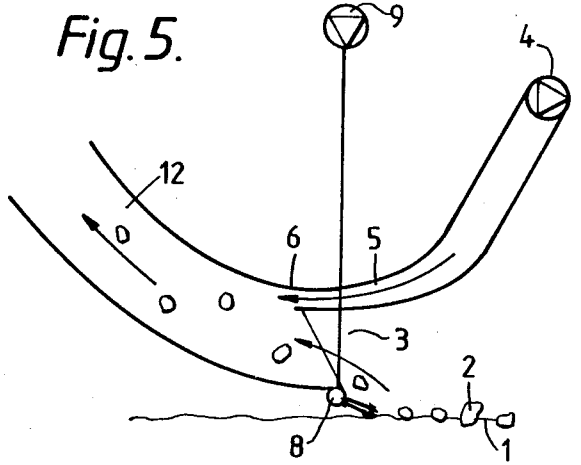

FIGS. 5 to 8 represent alternative solutions of the location of the intake opening and the removing device. In FIGS. 5 and 6 the lower wall of conveying channel 12 reaches the vicinity of nozzle 5 or even by it, in which case the level of intake opening 3 is almost vertical. In FIG. 5 spray pipe 8 has been placed behind the intake opening from where it directs the removing spray obliquely forwards and downwards. In this way the removing spray will hit the nodules so that they can be removed from the bottom of the sea. In FIG. 6, the spray pipe 7 has been placed in front of the intake opening, and the spray is directed from there obliquely backwards and downwards, or in any other desired direction.

Figure 8:
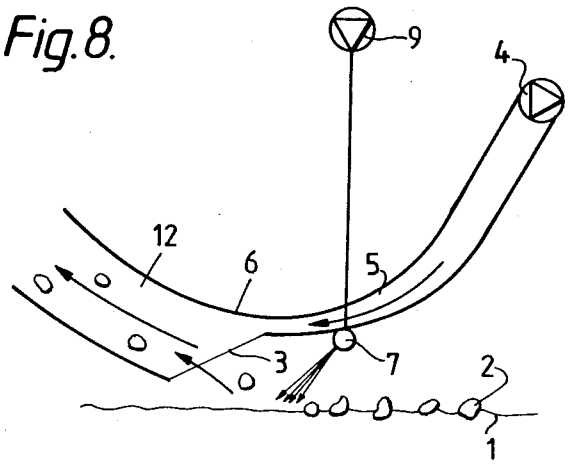
Figure 7:
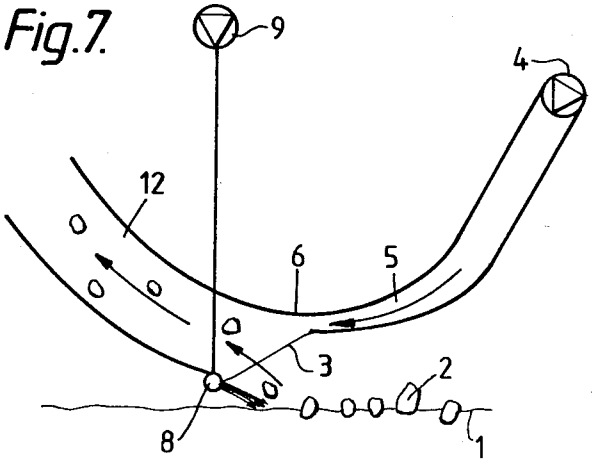

In the applications described in FIGS. 7 and 8 the lower wall of conveying channel 12 ends behind nozzle 5 so that the level of intake opening 3 is near the horizontal level. In FIG. 7, spray pipe 8 is behind the intake opening and in FIG. 8 spray pipe 7 is in front of the intake opening.

Figure 10:
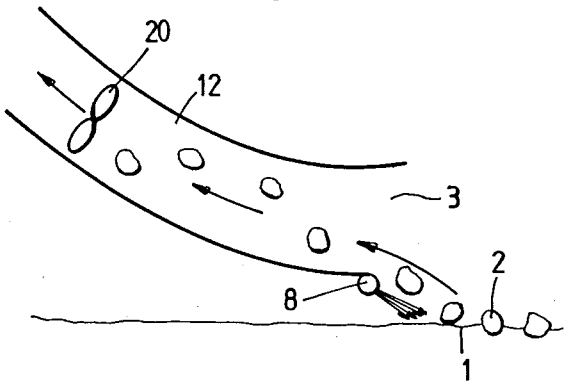
- FIGS. 9 and 10 are views of alternative applications to bring about the conveying flow to the intake opening as an vertical shear and
- FIGS. 11 and 12 are views of two alternatives of the removing device.
Figure 9:
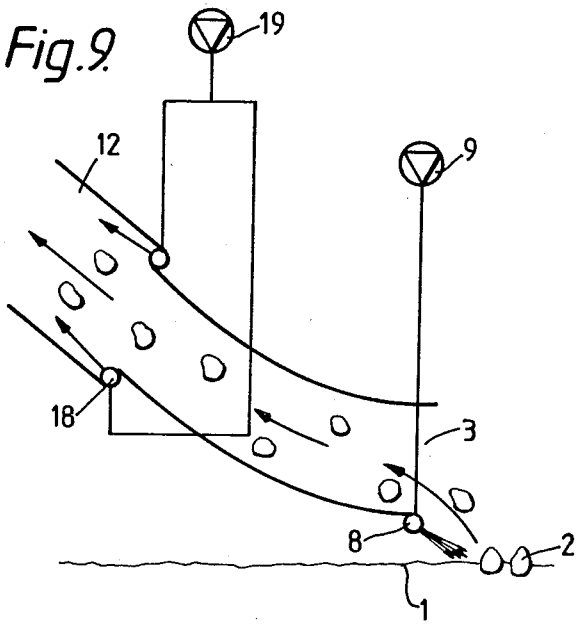

In FIGS. 9 and 10 some alternative solutions have been shown to bring about a flow in the conveying channel 12. In FIG. 9, the nozzle 5 has been replaced by spray pipes located in the walls of the channel behind the intake opening. Pump 19 brings about sprays from pipes 18 in the conveying direction, whereby a suction is created through intake opening 3 and the flow continues in the conveying direction. In FIG. 10, the flow is brought about by means of a propeller 20 placed in conveying channel 12. Also in these applications, the level of the intake opening can be almost parallel, like in FIGS. 7 and 8.

Removing sprays 7 and 8 can be replaced also by other kinds, for example mechanical removing devices.

Figure 12:
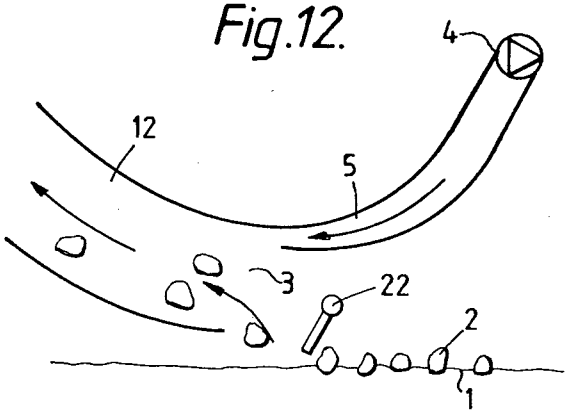
Figure 11:
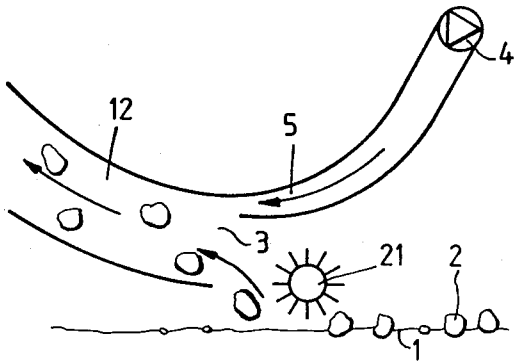

FIG. 11 shows a revolving pin roller or brush 21, whereas in FIG. 12 flexible rubber splint 22 dragged along the surface has been used. Spray pipe 7 can also be curved on the bottom level so that a spray flow is directed towards the centre of the device. In this way, removed nodules can be collected within a larger area into a narrower conveying flow.

When the lowermost part of the removing device moves above the bottom level of the water area it is recommended that the whole collecting head, except the travelling mechanism is located above the bottom level.

Operation of the device has been described in the foregoing. The device can naturally be used also on the bottom of rivers and lakes, if there is something worth collecting there. Also other objects than mangan nodules can be collected with the device.

What is claimed is:

1. A method of collecting objects protruding from the bottom level of a seabed with a collecting device having a removing means, comprising the steps of:

moving the collecting device along the seabed with the removing means at or above the bottom level of the seabed;

removing the objects protruding from the bottom level of the seabed with the removing means while allowing the remainder of the seabed to remain substantially undisturbed;

creating a waterflow in a conveying channel independently of the removing means; and conveying the removed objects through the conveying channel to a collection location by means of the waterflow flowing through said conveying channel.

2. The method of claim 1, wherein the removing step comprises removing the objects with a jet of water.

3. The method of claim 1, wherein the removing step includes contacting the objects with a mechanical device.

4. The method of claim 1, wherein the collecting device is only moved above the bottom level of the seabed.

5. A device for collecting objects protruding from the bottom level of a seabed, comprising:

a conveying channel having an object intake opening;

first means for flowing water through said conveying channel;

second means located adjacent the object intake opening for first separating the objects protruding from the bottom level of the seabed from the remainder of the seabed so as to leave the remainder of the seabed substantially undisturbed and then conveying the objects to the conveying channel through the object intake opening when said separating means is at or above the bottom level of the seabed; and means for collecting the objects at the end of the conveying channel.

6. The device of claim 5, wherein the water flowing means is controlled independently of the separating and conveying means.

7. The device of claim 5, wherein the separating and conveying means is a water jet.

8. The device of claim 7, wherein the water jet operates independently of the water flowing through the conveying channel.

9. The device of claim 7, wherein the inclination angle of the water jet is adjustable.

10. The device of claim 5, further comprising support means for maintaining the object intake opening above the bottom level of the seabed.

11. The device of claim 5, wherein the downstream edge of the object intake opening is lower than the upstream edge.

12. The device of claim 5, wherein the separating and conveying means is located before the object intake opening.

13. The device of claim 5, wherein the separating and conveying means is located after the object intake opening.

14. The device of claim 5, wherein the separating and conveying means is a pin roller.

15. A device for collecting objects protruding from the bottom level of a seabed, comprising:

a conveying channel having an object intake opening;

first means for flowing water through said conveying channel;

second means located adjacent the object intake opening for first separating only the objects protruding from the bottom level of the seabed from the seabed and then conveying the objects to the conveying channel through the object intake opening when said separating means is at or above the bottom level of the seabed;

means for collecting the objects at the end of the conveying channel; and further including a convex upper surface adjacent the object intake opening, wherein the water flowing means includes a nozzle located under the convex upper surface.

16. The device of claim 15, wherein the lower edge of the object intake opening is located upstream of the nozzle.

17. The device of claim 15, wherein the lower edge of the object intake opening is substantially below the nozzle.

18. The device of claim 15, wherein the lower edge of the object intake opening is downstream of the nozzle.

19. The device of claim 18, wherein the separating and conveying means is a water jet mounted at the lower edge of the object intake opening.

20. The device of claim 15, wherein the separating and conveying means is a water jet mounted at the lower edge of the object intake.

* * * * *